US011613874B2

(12) United States Patent
Serrurier et al.

(10) Patent No.: US 11,613,874 B2
(45) Date of Patent: Mar. 28, 2023

(54) IMPLEMENT TIP ASSEMBLY HAVING TIP WITH WEAR INDICATOR

(71) Applicant: CATERPILLAR INC., Peoria, IL (US)

(72) Inventors: Douglas Serrurier, Morton, IL (US); Eric Sinn, East Peoria, IL (US); Mihai Mircea Balan, Dunlap, IL (US); Jason Jura, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 243 days.

(21) Appl. No.: 16/655,741

(22) Filed: Oct. 17, 2019

(65) Prior Publication Data

US 2020/0048872 A1 Feb. 13, 2020

Related U.S. Application Data

(63) Continuation of application No. 15/782,877, filed on Oct. 13, 2017, now Pat. No. 10,480,161.

(60) Provisional application No. 62/434,625, filed on Dec. 15, 2016.

(51) Int. Cl.
*E02F 9/28* (2006.01)

(52) U.S. Cl.
CPC ..... *E02F 9/2825* (2013.01); *E02F 9/2833* (2013.01); *E02F 9/2858* (2013.01); *E02F 9/2883* (2013.01)

(58) Field of Classification Search
CPC ..... E02F 9/2825; E02F 9/2833; E02F 9/2858; E02F 9/2883
See application file for complete search history.

(56) References Cited

U.S. PATENT DOCUMENTS

| | | | |
|---|---|---|---|
| 5,144,762 | A | 9/1992 | Robinson |
| 5,423,138 | A | 6/1995 | Livesay et al. |
| 6,032,390 | A | 3/2000 | Bierwith |
| H2020 | H | 5/2002 | Kesavan et al. |
| 8,191,291 | B2 | 6/2012 | Vanderpoorten et al. |
| 8,943,717 | B2 | 2/2015 | Renski et al. |
| 9,057,177 | B2 | 6/2015 | Renski et al. |
| 9,222,243 | B2 | 12/2015 | Cheyne et al. |

(Continued)

FOREIGN PATENT DOCUMENTS

| | | |
|---|---|---|
| EA | 011819 | 6/2009 |
| EA | 022167 | 11/2015 |

(Continued)

*Primary Examiner* — Gary S Hartmann
(74) *Attorney, Agent, or Firm* — Finnegan, Henderson, Farabow, Garrett & Dunner, LLP

(57) ABSTRACT

A ground engaging tip of a tip assembly for a base edge of a ground engaging implement has an adapter configured for attachment to the base edge of implement and having a forwardly extending adapter nose. The ground engaging tip has a rear edge, a top outer surface, and a bottom outer surface. The top outer surface and the bottom outer surface extend forward from the rear edge of the ground engaging tip and converge at a front edge of the ground engaging tip. The ground engaging tip also has a nose cavity, within the ground engaging tip and defined between the converging top and bottom outer surfaces of the ground engaging tip, for receiving the adapter nose therein. The nose cavity includes a wear indicator extending from an inner surface of the nose cavity, into the ground engaging tip, toward the bottom outer surface of the ground engaging tip.

20 Claims, 12 Drawing Sheets

(56) References Cited

U.S. PATENT DOCUMENTS

| | | | | |
|---|---|---|---|---|
| 10,024,034 | B2 | 7/2018 | Nicoson et al. | |
| 10,480,161 | B2 * | 11/2019 | Serrurier | E02F 9/2825 |
| 2013/0086827 | A1 | 4/2013 | Renski et al. | |
| 2014/0173948 | A1 * | 6/2014 | Ok | B23P 6/00 37/452 |
| 2014/0352182 | A1 | 12/2014 | LaHood et al. | |
| 2015/0013198 | A1 | 1/2015 | Tanaka et al. | |
| 2015/0033599 | A1 | 2/2015 | Kunz | |
| 2015/0149049 | A1 | 5/2015 | Bewley et al. | |
| 2016/0083935 | A1 | 3/2016 | Edmonds | |
| 2016/0177543 | A1 | 6/2016 | Bjerke et al. | |

FOREIGN PATENT DOCUMENTS

| | | |
|---|---|---|
| EP | 1174547 | 8/2006 |
| RU | 2107779 | 3/1998 |
| WO | WO 2005/045142 A1 | 5/2005 |
| WO | 2013/052826 | 4/2013 |
| WO | WO 2015/165505 | 11/2015 |

* cited by examiner

IMPLEMENT TIP ASSEMBLY HAVING TIP WITH WEAR INDICATOR

CROSS-REFERENCE TO RELATED APPLICATIONS

This application is a continuation of U.S. patent application Ser. No. 15/782,877, filed Oct. 13, 2017, which claims the benefit of priority of U.S. Provisional Patent Application No. 62/434,625, filed Dec. 15, 2016. The content of the above-referenced applications is expressly incorporated herein by reference in its entirety.

TECHNICAL FIELD

This disclosure relates generally to earth working machines with ground engaging implements and, in particular, to tip assemblies with replaceable tip and adapter systems attached to the leading or base edges of such ground engaging implements.

BACKGROUND

Earth moving machines known in the art are used for digging into the earth or rock and moving loosened work material from one place to another at a worksite. These machines and equipment typically include a body portion housing the engine and having rear wheels, tracks or similar components driven by the engine, and an elevated cab for the operator. The machines and equipment may further include articulating mechanical arms or other types of linkages, such as Z-bar linkages, for manipulating one or more implements of the machine. The linkages may be capable of raising and lowering the implements and rotating the implements to engage the ground or other work material in a desired manner. In the earth moving applications, the implements of the machines or other equipment may be buckets with a beveled lip or blade on a base edge for moving or excavating dirt or other types of work material.

To facilitate the earth-moving process, and to prolong the useful life of the implement, a plurality of tip assemblies may be placed along the base edge of the implement and attached to the surface of the implement. The tip assemblies project forward from the base edge as a first point of contact and penetration with work material, and to reduce the amount of wear of the base edge. With this arrangement, the tip assemblies may be subjected to the wear and breakage caused by repetitive engagement with the work material. Eventually, the tip assemblies must be replaced, but the implement may remain usable through multiple cycles of replacement tip assemblies. Depending on the variety of uses and work material for the equipment, it may also be desirable to change the type or shape of the tip assemblies to most effectively utilize the implement.

In many implementations, installation and replacement of the tip assemblies may be facilitated by providing the tip assemblies as a two-part system. The system may include an adapter that is attached to the base edge of the implement, a ground-engaging tip configured to be attached to the adapter, and a retention mechanism securing the tip to the adapter during use. The adapter may be welded, bolted, or otherwise secured to the base edge, and then the tip may be attached to the adapter and held in place by the retention mechanism.

The tip endures most of the impact and abrasion of engagement with the work material. Thus, the tip may wear down more quickly and break more often than the adapter.

Consequently, multiple tips may be attached to the adapter, worn down, and replaced before the adapter itself must be replaced. Eventually, the adapter may wear down and require replacement. If an adapter is regularly used with worn tips, the adapter may wear down or break more quickly than intended. This can be problematic, for example, if an adapter is significantly more expensive, or more difficult to obtain, than a tip.

U.S. Patent Application Publication No. 2014/01739848 to Ok et al. ("the '848 publication") describes a wear indicator for an excavating tooth. The excavating tooth has a bore on the front of its adapter recess extending horizontally toward the tip. A wear indicator is located inside the bore. When the tip of the tooth wears down, the wear indicator becomes visible.

While the wear indicator solution of the '848 publication may help identify a worn excavator tooth, it may have certain drawbacks. For example, the configuration of the wear indicator may not work well in non-excavator applications, such as a bottom-wearing applications. Additionally, the '848 publication's wear indicator may not adequately protect certain parts of the adapter from wear or damage. The '848 publication's excavator tooth may have additional issues, such as excess material in certain areas, making the part heavier and more expensive than it needs to be. On the other hand, the excavator tooth may lack features that provide additional support in areas of high stress.

This disclosure is directed to overcoming one or more of the problems set forth above and other problems in the art.

SUMMARY OF THE DISCLOSURE

One aspect of the disclosure relates to a ground engaging tip of a tip assembly for a base edge of a ground engaging implement. The tip assembly may include an adapter configured for attachment to the base edge of the ground engaging implement and having a forwardly extending adapter nose. The ground engaging tip may include a rear edge, a top outer surface, and a bottom outer surface, and the top outer surface and the bottom outer surface may extend forward from the rear edge of the ground engaging tip and converge at a front edge of the ground engaging tip. The ground engaging tip may also include a nose cavity, within the ground engaging tip and defined between the converging top and bottom outer surfaces, for receiving the adapter nose. The nose cavity may include a wear indicator at a front end of the nose cavity and extending from an inner surface of the nose cavity, into the ground engaging tip, toward the bottom outer surface of the ground engaging tip.

Another aspect of the disclosure relates to a ground engaging tip assembly for a base edge of a ground engaging implement. The ground engaging tip assembly may include an adapter and a ground engaging tip. The adapter may have a nose and top and bottom straps defining a gap for receiving a base edge of the ground engaging implement. The ground engaging tip may include a rear edge, a top outer surface, and a bottom outer surface. The top outer surface and the bottom outer surface may extend forward from the rear edge of the ground engaging tip and converge at a front edge of the ground engaging tip. Additionally, the ground engaging tip may include a nose cavity, within the ground engaging tip and defined by the converging top and bottom outer surfaces, for receiving the nose of the adapter therein. The nose cavity may include a wear indicator at a front end of the nose cavity and extending from an inner surface of the nose cavity, into the ground engaging tip, toward the bottom outer surface of the ground engaging tip.

Yet another aspect of the disclosure is directed to a ground engaging tip of a tip assembly for a base edge of a ground engaging implement. The tip assembly may include an adapter configured for attachment to the base edge of the ground engaging implement and having a forwardly extending adapter nose. The ground engaging tip may include a rear edge, a top outer surface, and a bottom outer surface. The top outer surface and the bottom outer surface may extend forward from the rear edge of the ground engaging tip and converge at a front edge of the tip. The ground engaging tip may also include a nose cavity, within the ground engaging tip and defined between the converging top and bottom outer surfaces, for receiving the adapter nose therein. The nose cavity may include front and bottom inner surfaces and a wear indicator. The wear indicator may be at an intersection of the front and bottom inner surfaces of the nose cavity and may extend into the ground engaging tip toward the bottom outer surface of the ground engaging tip.

DETAILED DESCRIPTION

Figure 1:
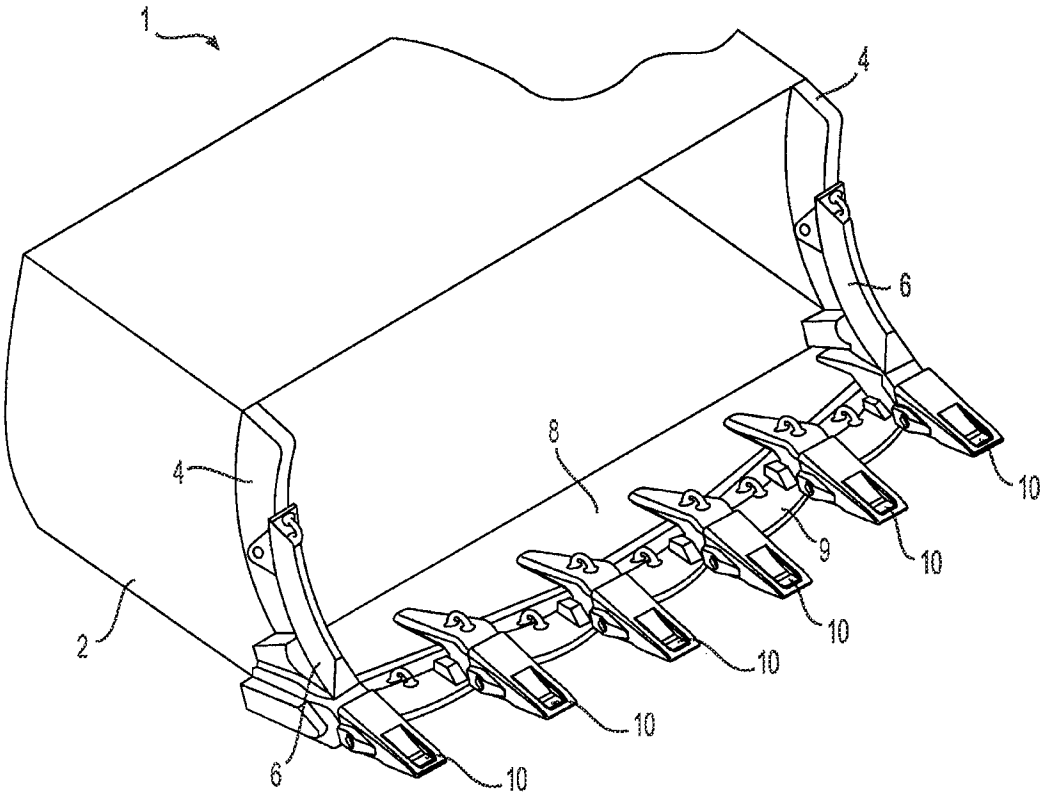
FIG. 1 is an isometric view of a loader bucket having tip assemblies in accordance with the present disclosure.

Referring now to FIG. 1, there is shown an implement for a bottom-wearing application, such as a loader machine application. The implement may take the form of a bucket assembly 1 that incorporates the features of the present disclosure. The loader bucket assembly 1 may include a bucket 2 which is partially shown in FIG. 1. The bucket 2 may be used on the loader machine to excavate material in a known manner. The bucket assembly 1 may include a pair of oppositely-disposed support arms 4 on which corresponding corner guards 6 may be mounted. The bucket assembly 1 may further included a number of edge protector assemblies 9 interposed between tip assemblies 10 in accordance with the present disclosure, with the edge protector assemblies 9 and the tip assemblies 10 being secured along a base edge 8 of the bucket 2.

Figure 2:
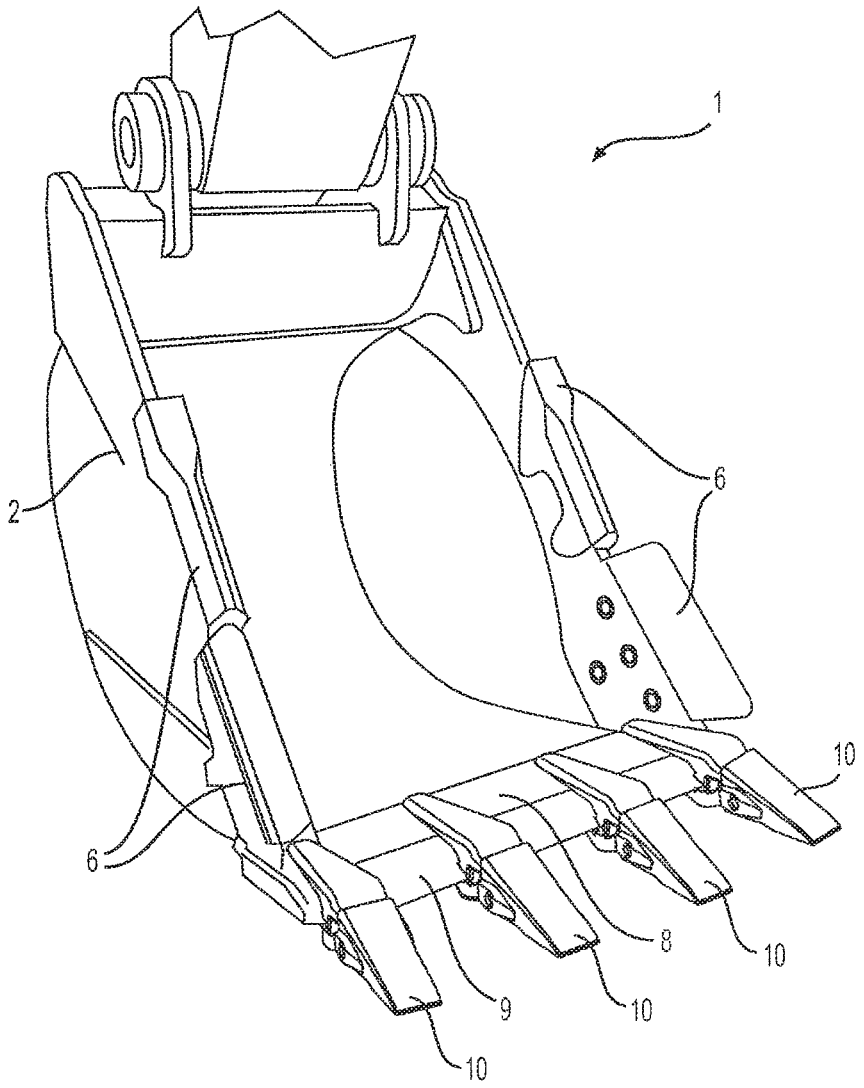
FIG. 2 is an isometric view of an excavator bucket having tip assemblies in accordance with the present disclosure attached at a base edge thereof.

FIG. 2 illustrates an implement for a top-wearing application, such as an excavator application. In this example, the implement has the form of an excavator bucket assembly 1. The excavator bucket assembly 1 may include a bucket 2 having corner guards 6 on either side, as well as a plurality of tip assemblies 10 attached to the base edge 8 of the bucket 2.

Various embodiments of tip assemblies are described that may be implemented in bottom-wearing or top-wearing applications. Even where a particular tip assembly or component embodiment may be described with respect to a particular bottom-wearing or top-wearing application, those skilled in the art will understand that the tip assemblies are not limited to a particular type of application and may be interchangeable between implements of various applications.

Figure 3:
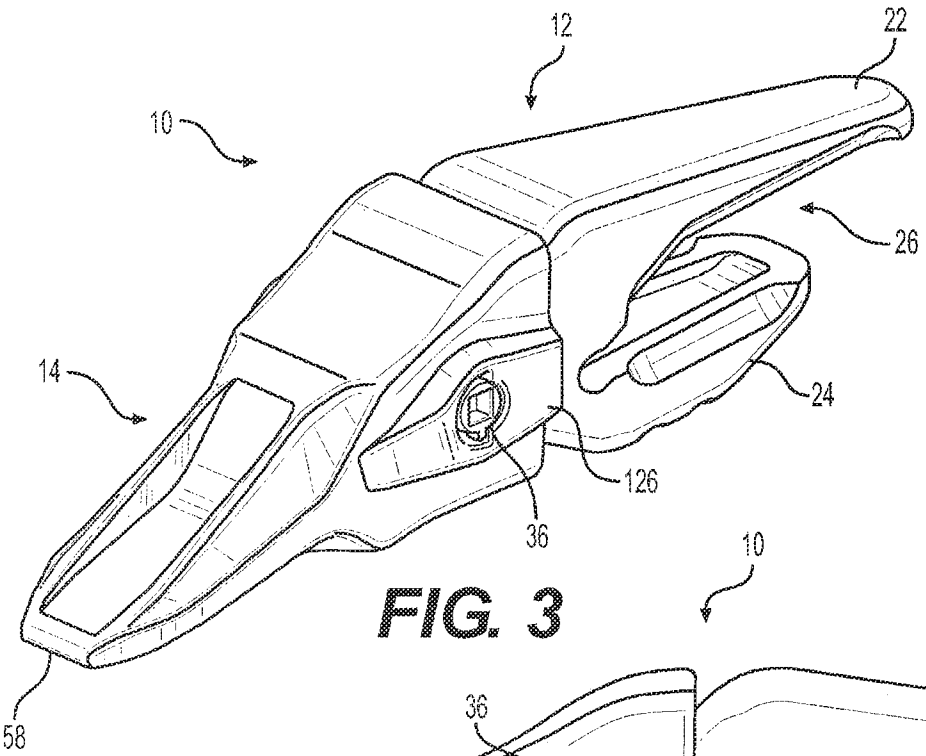
FIG. 3 is an isometric view of a tip assembly in accordance with the present disclosure.
Figure 4:
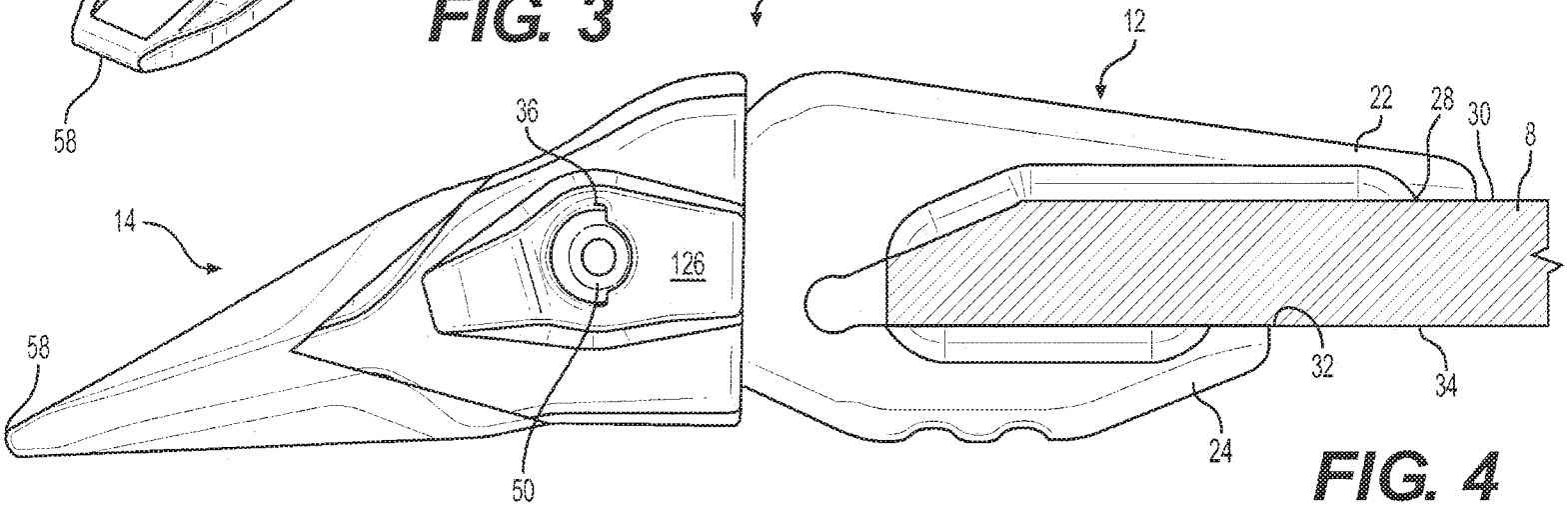
FIG. 4 is a side view of the tip assembly of FIG. 3.

FIGS. 3 and 4 illustrate an embodiment of a tip assembly 10 in accordance with the present disclosure that may be useful with earth moving implements, and have particular use in top-wearing applications. The tip assembly 10 may be used on multiple types of ground engaging implements that have a base edge 8. The tip assembly 10 may include an adapter 12 configured for attachment to a base edge 8 of the implement 1, and a ground engaging tip 14 configured for attachment to the adapter 12. The tip assembly 10 may further include a retention mechanism securing the tip 14 to the adapter 12, as explained below. The retention mechanisms may utilize aspects of the adapter 12 and tip 14, such as retention apertures 36 through the sides of the tip 14. Those skilled in the art will understand that many alternative retention mechanisms may be implemented in the tip assemblies 10 according to the present disclosure, and that the tip assemblies 10 are not limited to any particular retention mechanism(s). As shown in FIGS. 3 and 4, once attached to the adapter 12, the tip 14 may extended outwardly from a base edge 8 of the implement 1 for initial engagement with work material (not shown).

Figure 5:
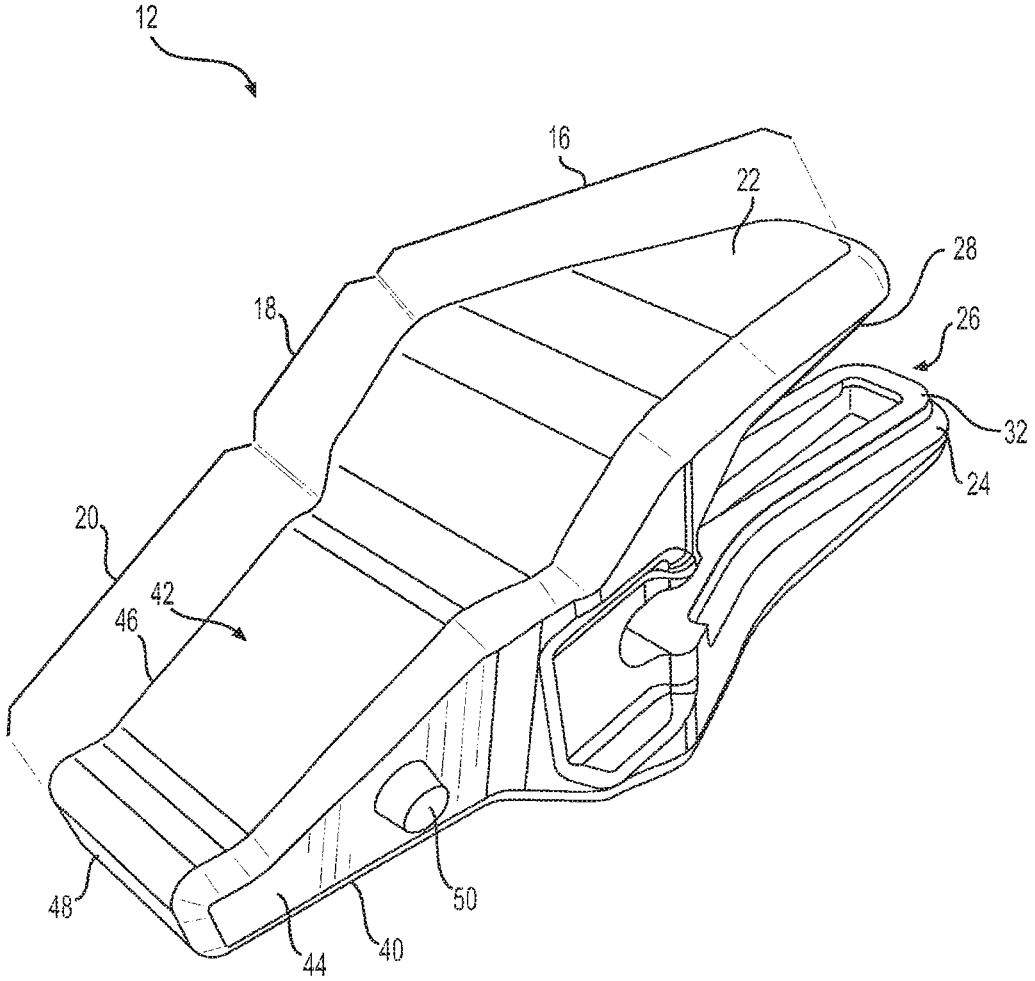
FIG. 5 is an isometric view of an adapter of the tip assembly of FIG. 3.
Figure 6:
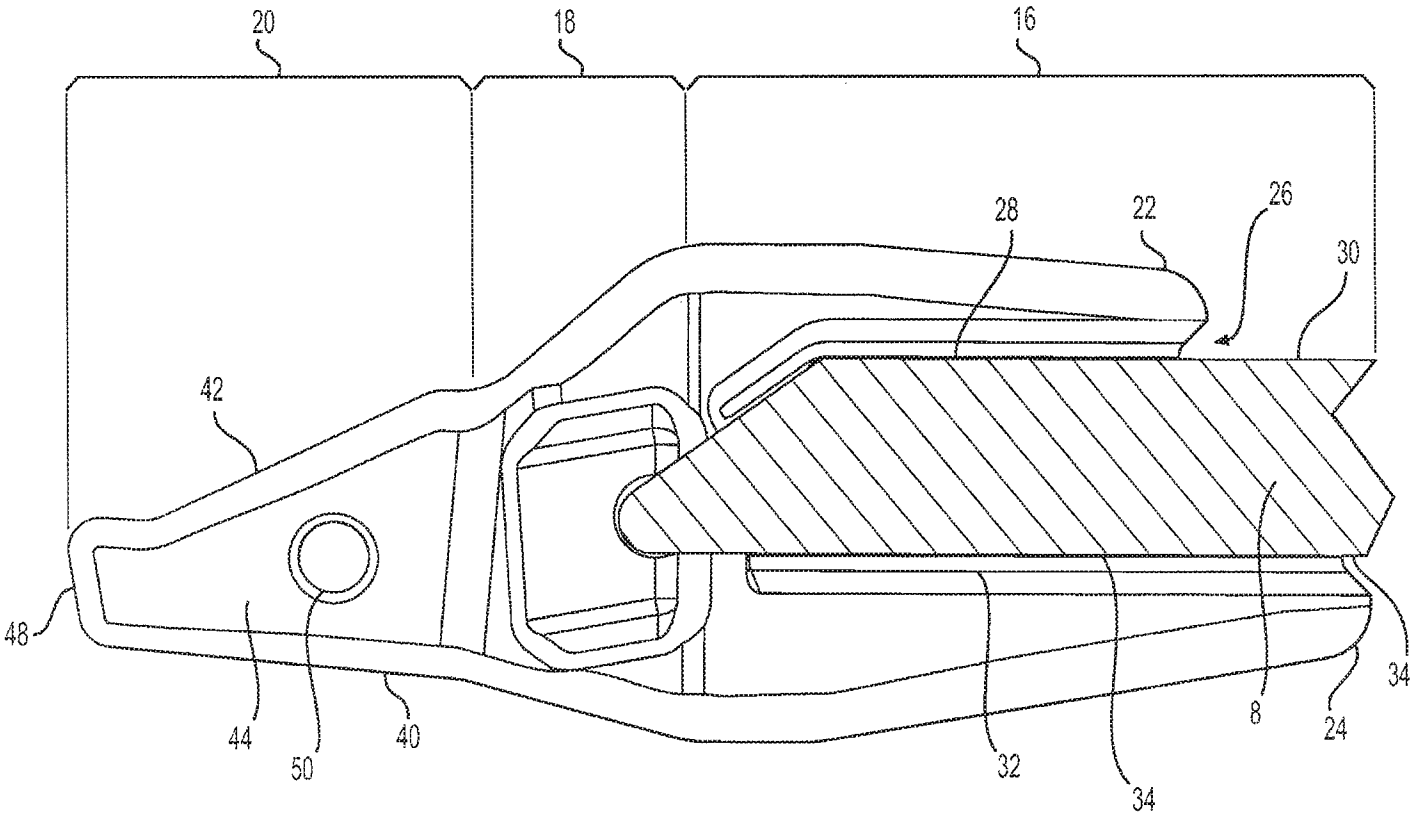
FIG. 6 is a side view of the adapter of FIG. 5 attached to a base edge of an implement.
Figure 7:
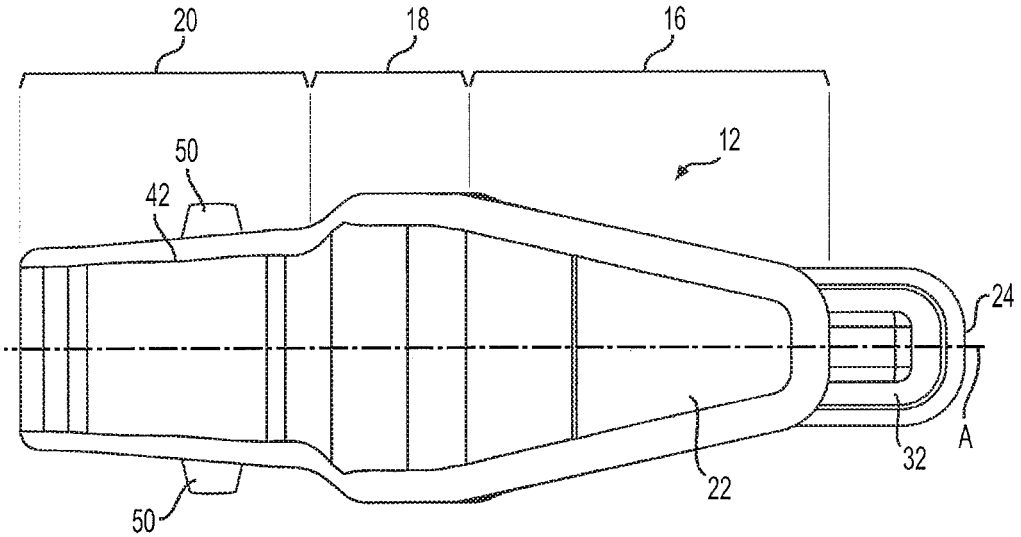
FIG. 7 is a top view of the adapter of FIG. 5.

An embodiment of the adapter 12 is shown in greater detail in FIGS. 5-7. Referring to FIG. 5, the adapter 12 may include a rear portion 16, an intermediate portion 18, and a nose 20, as indicated by brackets. The intermediate portion 18 may separate the rear portion 16 and the nose 20.

The rear portion 16 may include a top strap 22 and a bottom strap 24. The top strap 22 and the bottom strap 24 may define a gap 26 therebetween as shown in FIGS. 5 and 6 for receiving the base edge 8 of the implement 1. The top strap 22 may have a bottom surface 28 that may oppose and engage a top surface 30 of the base edge 8. The bottom strap 24 may have a top surface 32 that may oppose and engage a bottom surface 34 of the base edge 8.

The adapter 12 may be secured in place on the base edge 8 of the implement 1 by attaching the top strap 22 and the bottom strap 24 to the base edge 8 using any connection method or mechanism known to those skilled in the art. In one embodiment, the straps 22, 24 and the base edge 8 may have corresponding apertures 36 through which fasteners (not shown) such as bolts or rivets may be inserted to hold the adapter 12 in place. Alternatively, the top and bottom straps 22, 24 may be welded to the corresponding top and bottom surfaces 30, 34 of the base edge 8 so that the adapter 12 and the base edge 8 do not move relative to each other during use.

The intermediate portion 18 of the adapter 12 may provide a transition between the straps 22, 24 and the nose 20 extending outwardly from the front end of the adapter 12. The nose 20 may be configured to be received by a corresponding nose cavity 38 (FIGS. 8, 10, and 11) of the tip 14, as will be described below. As shown in FIGS. 5 and 6, the nose 20 may have a bottom surface 40, a top surface 42, opposing side surfaces 44, 46, and a front surface 48. The bottom surface 40 may be generally planar and inclined upwardly relative to the top surface 32 of the bottom strap 24 and, correspondingly, the bottom surface 34 of the base edge 8.

The nose 20 may support the tip 14 during use of the implement 1 and facilitate retention of the tip 14 on the nose 20 when bearing the load of the work material in the implement 1. As shown in FIG. 5, the nose 20 may have a pair of lugs 50 projecting from each of the side surfaces 46, 48 (only one shown in FIG. 6).

The lugs 50 may function as part of a retention mechanism for holding the tip 14 on the nose 20. In particular, the lugs 50 may be positioned and configured to align with, and engage, the corresponding apertures 36 (FIG. 3) of the tip 14.

Figure 8:
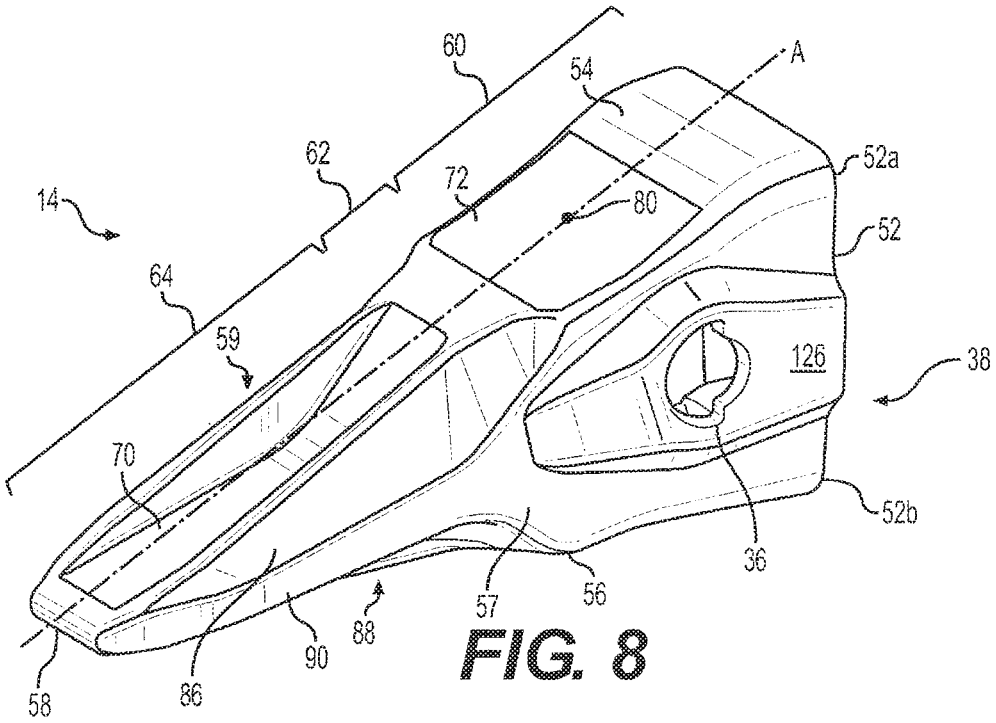
FIG. 8 is an isometric view of a tip of the tip assembly of FIG. 3.
Figure 9:
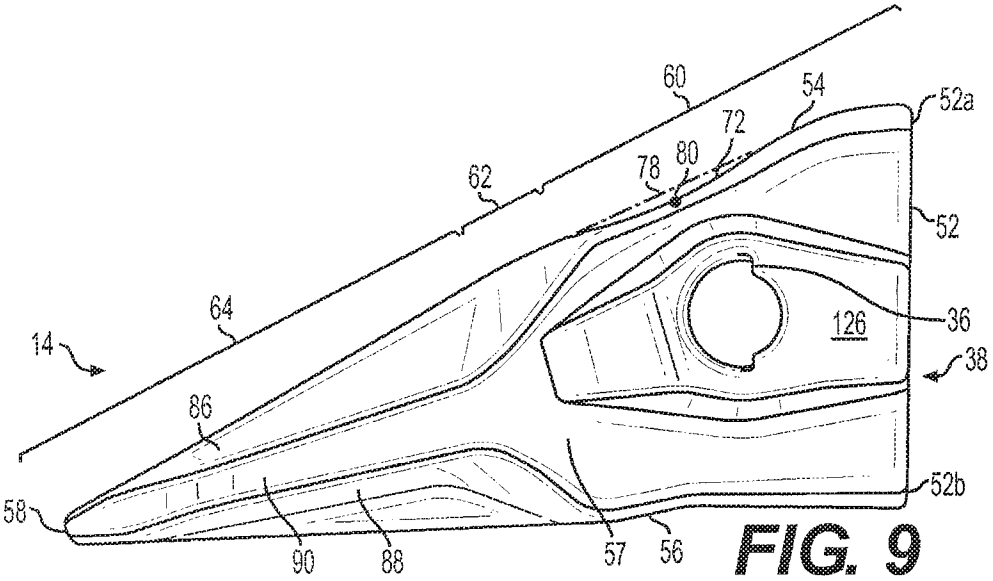
FIG. 9 is a side view of the tip of FIG. 8.
Figure 10:
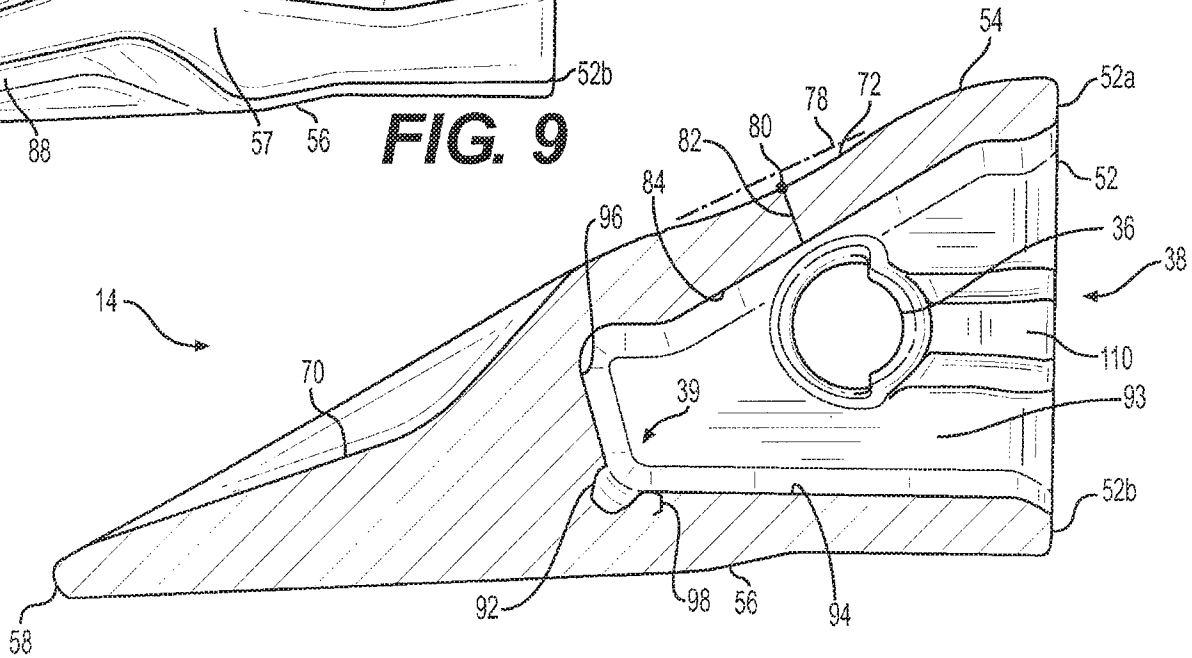
FIG. 10 is a cross-sectional view of the tip of FIG. 8.

FIGS. 8-10 illustrate the tip 14 of the tip assembly 10 consistent with the disclosed embodiments. The tip 14 may be generally wedge-shaped and have a rear edge 52. The tip may have a top outer surface 54 extending forward from a top 52*a* of the rear edge 52. The tip 14 may also include a bottom outer surface 56 extending forward from a bottom 52*b* of the rear edge 52 of the tip 14. The tip 14 may also have side outer surfaces 57, 59.

The top outer surface 54 may generally slope downward, and the bottom outer surface 56 may extend forward in a direction generally perpendicular to the rear edge 52, such that the top outer surface 54 and the bottom outer surface 56 converge at a front edge 58 at the front of the tip 14. The top outer surface 54 may present a generally planar surface. However, in some embodiments, the top outer surface 54 may have certain features giving the top outer surface 54 a desired shape.

As shown in FIGS. 8-10, the top outer surface 54 of the tip 14 may include a rear portion 60, a middle portion 62, and a front portion 64. The front portion 64 may generally slope upward from the front edge 58 to the middle portion 62. The front portion 64 may have a generally planar configuration that allows work material to slide up the top outer surface 54 and toward the base edge 8 of the implement 1 when its front edge 58 digs into a pile of work material.

The middle portion 62 of the top outer surface 54 may serve as a transition between the front portion 64 and the rear portion 60. In one embodiment, the middle portion 62 may be generally planar and slope generally upward. The middle portion 62 may slope upward at a different angle than the rear portion 60 and/or the front portion 64.

The front portion 64 may have surface features for cutting and penetrating into work material. For example, behind the front edge 58, the front portion 64 may have a scoop section 70. In scoop section 70, the top outer surface 54 of the tip 14 may be depressed below the top outer surface 54 in other areas, such as in the rear and middle portions 60, 62. The scoop section 70 may thus give the tip 14 a knife-like shape for cutting and penetrating into work material.

In typical bottom-wearing applications such as the one shown in FIGS. 8 and 9, the tip 14 may experience less stress and impact from material at the rear portion 60 than elsewhere on the tip. Thus, less material may be necessary in the region of the rear portion 60. As shown in FIGS. 8 and 9, consistent with the disclosed embodiments, the rear portion 60 may have a concave section 72 in the rear portion 60 of the tip 14. The concave section 72 may reduce the weight and/or cost of the tip 14 because it requires less material to make than a tip that lacks the concave section 72. Thus, the concave section 72 may be included, reducing the weight and cost of the tip, without substantially impacting the useful life or integrity of the tip 14.

FIG. 10 is a partial cross-sectional side view of the tip 14 that illustrates the concave section 72. As shown in this Figure, the concave section 72 provides a depression that would fall below a flat surface 78 of the rear portion of a tip 14 that lacks the concave section 72 but is otherwise the same. In one embodiment, at its deepest point 80, the tip 14 may provide about a 35% reduction in a wall thickness 82 of the top outer surface 54 in the rear portion 60 as compared to a tip without the concave section 72. The wall thickness 82 may represent a distance between the top outer surface 54 in the rear portion 60 and a top inner surface 84 of the nose cavity 38. A 35% reduction in thickness is non-limiting and provided as an example only, as other designs with a larger or smaller reduction in wall thickness 82 may be utilized. The depth of the concave section 72 may be selected to provide any desired wall thickness 82 in the rear portion 60 appropriate for a given application.

The tip 14 may have other features for cutting into work material and driving the material into the implement. For example, as shown in FIGS. 8 and 9, the side outer surfaces 57, 59 of the tip 14 may have top and bottom angled portions 86, 88 joined by a flat portion 90 (one side shown).

Figure 11:
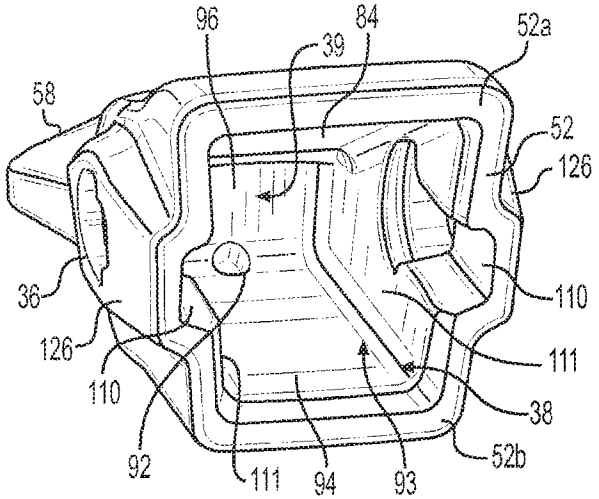
FIG. 11 is a rear view of the tip of FIG. 8.
Figure 12:
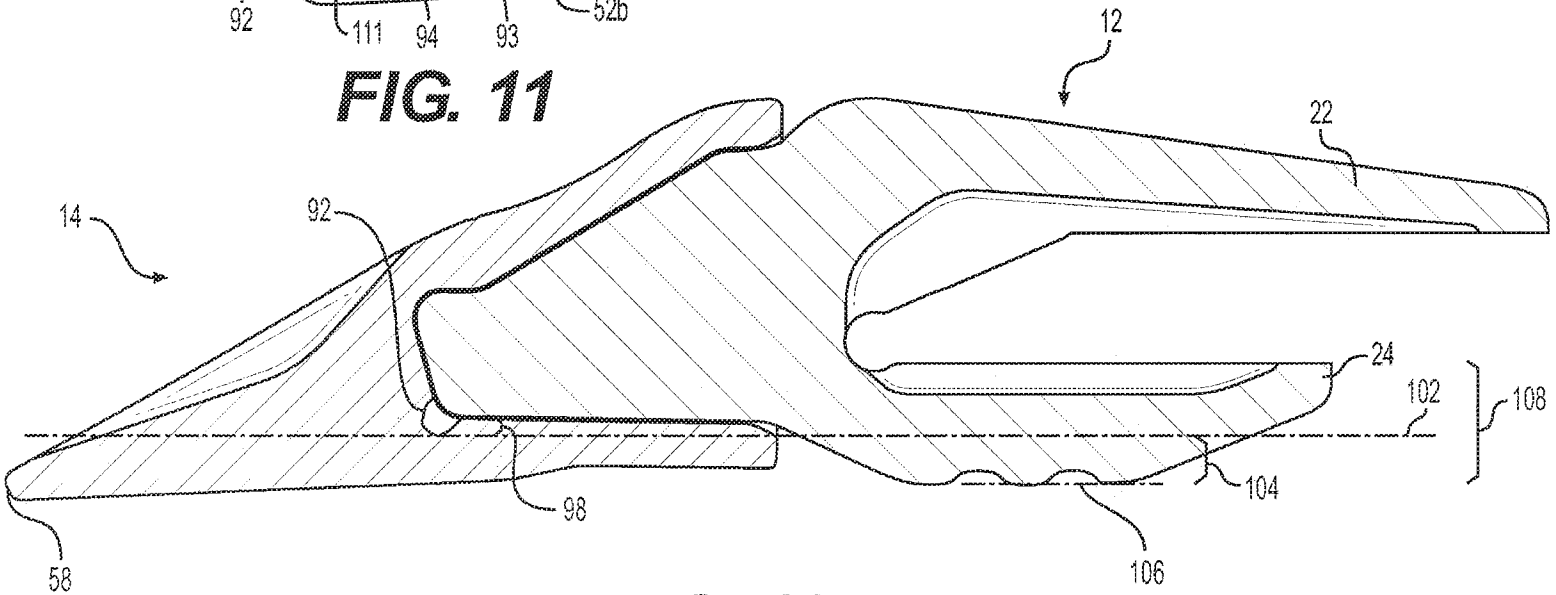
FIG. 12 is a side view of the tip of FIG. 8.
Figure 13:
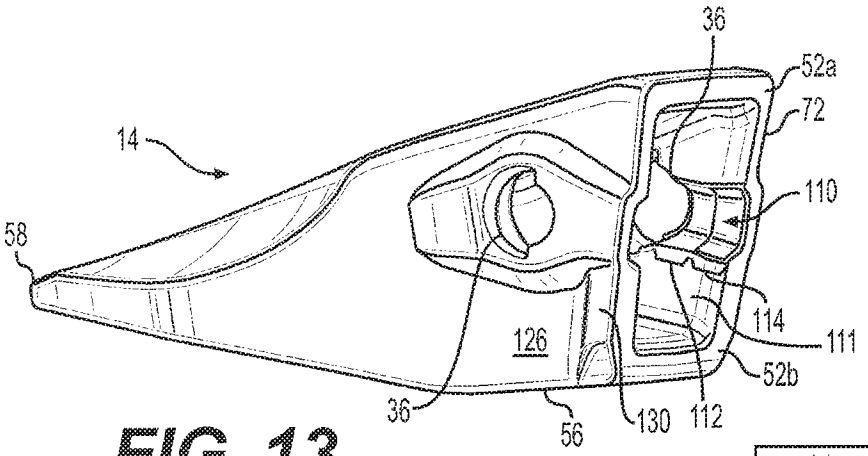
FIGS. 13-18 illustrate a tip having a tapered retention channel and a support rib, consistent with the disclosed embodiments.

FIGS. 10-12 show a wear indicator 92 for the tip 14, consistent with the disclosed embodiments. The wear indicator 92 may enable a worker to better determine when the tip 104 is worn and should be replaced, before potentially damaging the adapter 12, or causing unnecessary wear, in further use.

As shown, the wear indicator 92 may be located within the nose cavity 38 that receives the adapter 12. In one embodiment, the wear indicator 92 may be a small opening (i.e., an empty region) protruding from the nose cavity 38 into an inner wall 93 of the tip 14. As the material of the tip 14 wears away, the working surface of the tip 14, such as the bottom outer surface 56, approaches the wear indicator 92. When the working surface of the tip 14 is worn to the point that it reaches the wear indicator 92, the wear indictor 108 may appear as a visible hole in the tip 14. Seeing the now-visible wear indicator 92, the worker may determine that the tip 14 should be replaced.

In other embodiments, rather than an empty region or opening, the wear indicator 92 may be an area of material that is different from the surrounding material of the tip 14. And when the different material of the wear indicator 92 becomes visible, it indicates to a worker that the tip 14 is worn and should be replaced. For example, the material of the wear indicator 92 may be a different color (e.g., red) than the surrounding material of the tip 14, so that the wear indicator 92 appears as a colored spot on the tip 14 when the tip 14 becomes sufficiently worn.

In one embodiment, the wear indicator 92 may be positioned in an area of the nose cavity 38 opposite the working surface of the tip 14 that experiences the most wear. In this way, the wear indicator 92 may become exposed before the adapter 12 is significantly damaged. For example, in a bottom-wearing application such as the one shown in FIGS. 10-12, the bottom outer surface 56, along with the front edge 58 of the tip 14 may experience the most wear. Thus, the wear indicator 92 may be located at the front end 39 of the nose cavity 38, where the nose 20 of the adapter 20 contacts the nose cavity 38. Additionally, the wear indicator 92 may be located on a bottom inner surface 94 of the nose cavity 38 or on a front inner surface 96 of the nose cavity. In the example shown, the wear indicator 92 is positioned at an intersection of the bottom and front inner surfaces 94, 96.

The wear indicator 92 may extend into the inner surface or surfaces of the nose cavity 38 to a desired depth 98. In the example shown in FIGS. 10-12, the wear indicator 92 extends generally forward and downward, in the direction of the front edge 58 and the bottom outer surface 56. In one embodiment, the wear indicator 92 may extend in a direction A that bisects the angle defined by the bottom and front inner surfaces 94, 96 of the nose cavity 38. Of course, however, depending on the particular application of the tip 14, other locations and configurations for the wear indicator 92 may be appropriate. For example, for a tip 14 with a top-wearing application, the wear indicator 92 may be located in a top inner surface 84 of the nose cavity 38, or at an intersection of the top inner surface 84 and the front inner surface 96.

FIG. 12 shows an exemplary way to determine a suitable depth 98 of the wear indicator 92 in the direction from the bottom inner surface 94 of the nose cavity 38 toward the bottom outer surface 56 of the tip 14. The depth 98 may be chosen to provide a desired amount of protection to the adapter 12. In one embodiment, in a bottom-wearing application, a horizontal wear line 102 may be chosen that extends through the tip 14 and the bottom strap 24 of the adapter 12. The vertical position of the wear line 102 may be selected to provide a desired wear distance 104 between an original (i.e., unworn) bottom surface 106 of the bottom strap 24 and the wear line 102. Then, the depth 98 of the wear indicator 92 may be chosen so that the wear indicator 92 intersects the wear line 102. This way, the wear indicator 92 may become visible when the bottom strap 24 has worn from its original bottom surface 106 to the wear line 102.

In the FIG. 12 example, the wear distance 104 corresponds to a thickness of the bottom strap 24 that is about 50% of its original thickness 108. Thus, the wear indicator 92 in this example would become visible when the bottom strap 24 is 50% worn. But any wear distance 104 may be used depending on how much adapter protection is desired or needed. And this amount of protection may, in turn, depend on a number of factors, such as the relative costs of the tip 14 and the adapter 12, the thickness of the bottom strap 24 needed to maintain structural integrity of the adapter 12, or the thickness of the bottom outer surface 56 of the tip 14 needed to maintain structural integrity of the tip 14. For example, if the adapter 12 costs much more than the tip 14, a smaller wear distance 104 may be chosen so that the wear indicator 92 appears before the bottom strap 24 suffers significant wear. This would help provide a longer useful life of the adapter 12 at the expense of the useful life of the tip 14, as indicated by the wear indicator 92. At the same time, if the adapter 12 is only slightly more expensive than the tip 14, a larger wear distance 104 may be selected to balance the useful lives of the tip 14 and the adapter 12.

As explained above, when mounting the tip 14 to the adapter 12, the lugs 50 on the adapter 12 mate with the corresponding apertures 36 on the tip 14 to secure the tip 14 to the adapter 12. FIGS. 10, 11, and 13-15 show a retention channel 110 in the nose cavity 38 of the tip 14 that may guide the lugs 50 to their respective apertures 36 during installation of the tip 14. The tip 14 may have a retention channel 110 on each inner side surface 111 of the nose cavity 38. The retention channel 110 may extend lengthwise from the rear edge 52 of the tip 14 to its respective aperture 36.

As shown in the Figures, the retention channel 110 may have an untapered portion 112 and a tapered portion 114. The untapered portion 112 may extend from an edge 116 of the aperture 36 to a front edge 118 of the tapered portion 114, where the untapered portion 112 ends. The tapered portion 114 may extend from its front edge 118 to the rear edge 52 of the tip 14.

In one embodiment, the tapered portion 114 may be longer than the untapered portion 112. For example, the tapered portion 114 may be two-thirds of the total length of the retention channel 110, and the untapered portion 112 may be one-third of the total length of the retention channel 110. The length of the untapered portion 112 may be the distance from the edge 116 of the aperture 36 to the front edge 118 of the tapered portion 114. The length of the tapered portion 114 may be the distance from the front edge 118 of the tapered portion 114 to the rear edge 52 of the tip 14. In other embodiments, different relative lengths of the tapered and untapered portions 112, 114 may be used.

The untapered portion 112 may be arranged such that an inner surface 120 of the untapered portion 112 extends in substantially the same direction as a major longitudinal axis "A" of the tip 14, defined by a line perpendicular to the front edge 58 and the rear edge 52 of the tip 14. The axis "A" is shown in FIGS. 7 and 8. The axis "A" is the direction at which the tip 14 engages the work material when in use. The untapered portion 112 may have a substantially constant cross-sectional area across its length.

Figure 14:
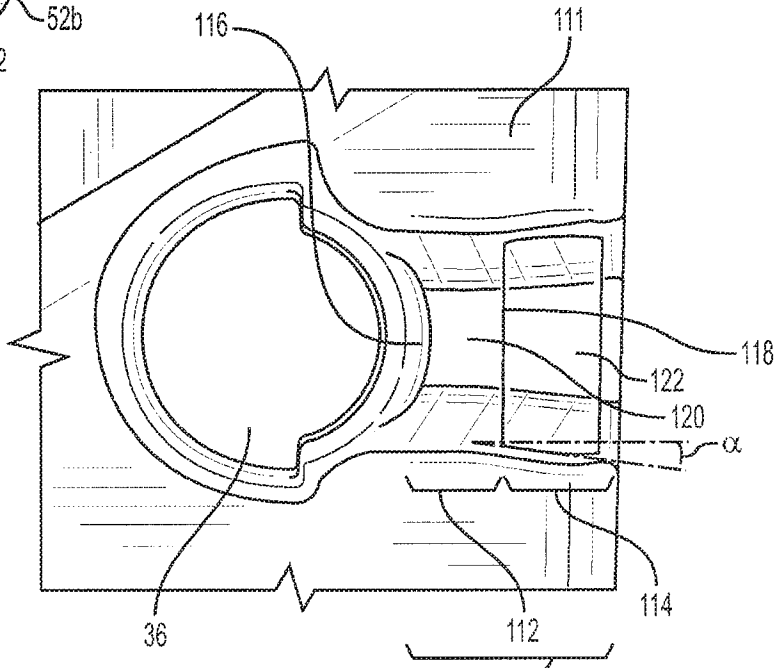
Figure 15:
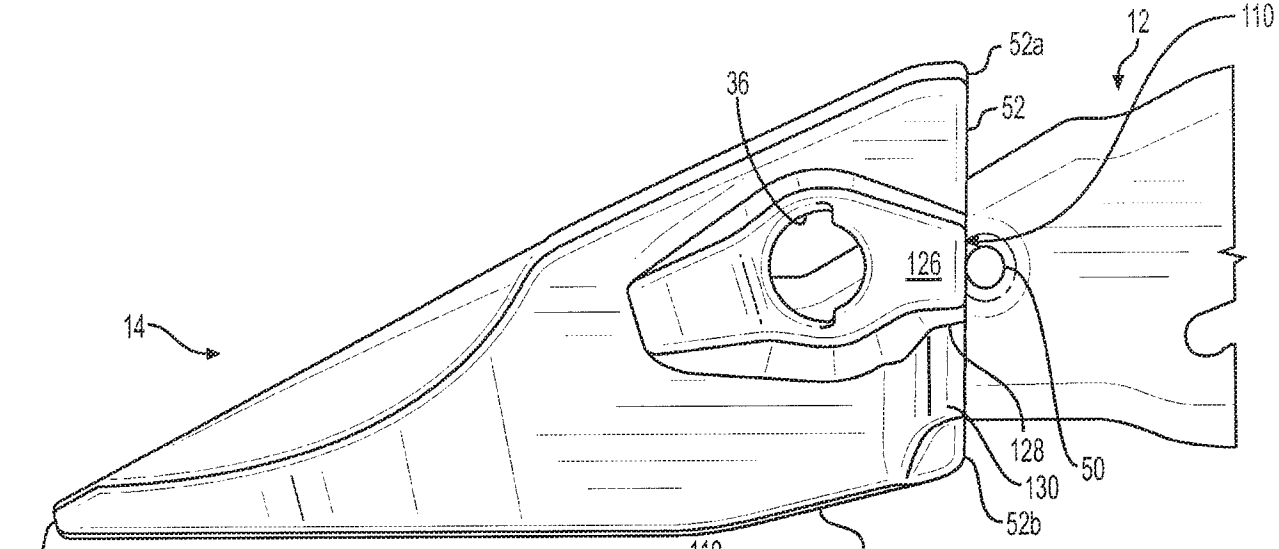

At the front edge 118, where the tapered portion 114 meets the untapered portion 112, the tapered portion 114 may have the same cross-sectional area as the untapered portion 112. The cross-section area of the tapered portion 114 may then gradually (e.g., linearly) increase from the front edge 118 to the rear edge 52 of the tip 14. Thus, the tapered portion 114 may be "wider" at the rear edge 52 than at the front edge 118. In one embodiment, the taper may be arranged so that an inner surface 122 of the tapered portion 114 is offset by a taper angle $\alpha$ relative to the inner surface 120 of the untapered portion 112, as shown in FIG. 14. In one embodiment, the taper angle $\alpha$ may about 5-10 degrees, but other taper angles may be selected.

Figure 16:
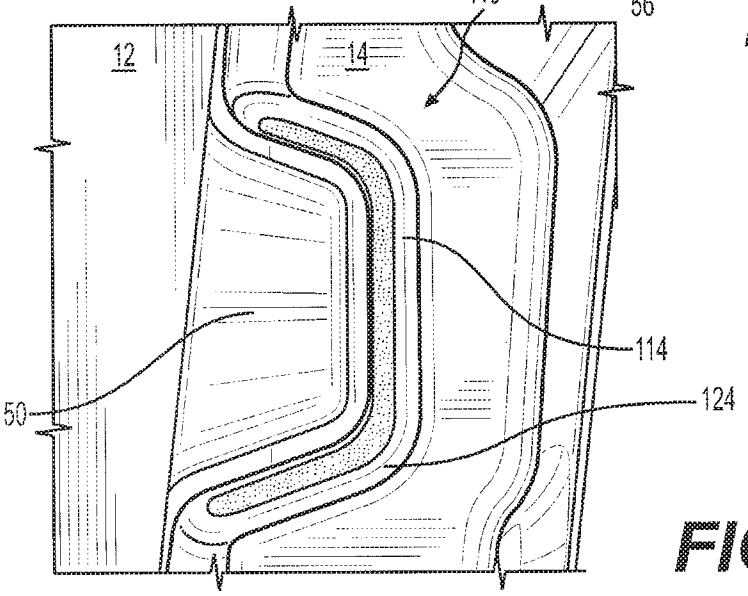

The taper may aid installation of the tip 14 onto the adapter 12. FIG. 16 shows a partial cross-sectional view (taken along the axis "A") of the tip 14 installed on the adapter 12, with the lug 50 secured in the aperture 36. When installing the tip 14 on the adapter 12, the worker must line up the lug 50 of the adapter with the retention channel 110 of the tip. As shown in the Figure, the taper provides additional area 124 beyond the cross-sectional area of the untapered portion 112 for lining up the lug 50 with the retention channel 110. The additional area 124 may make it easier for a worker to install the tip 14 on the adapter 12.

Figure 17:
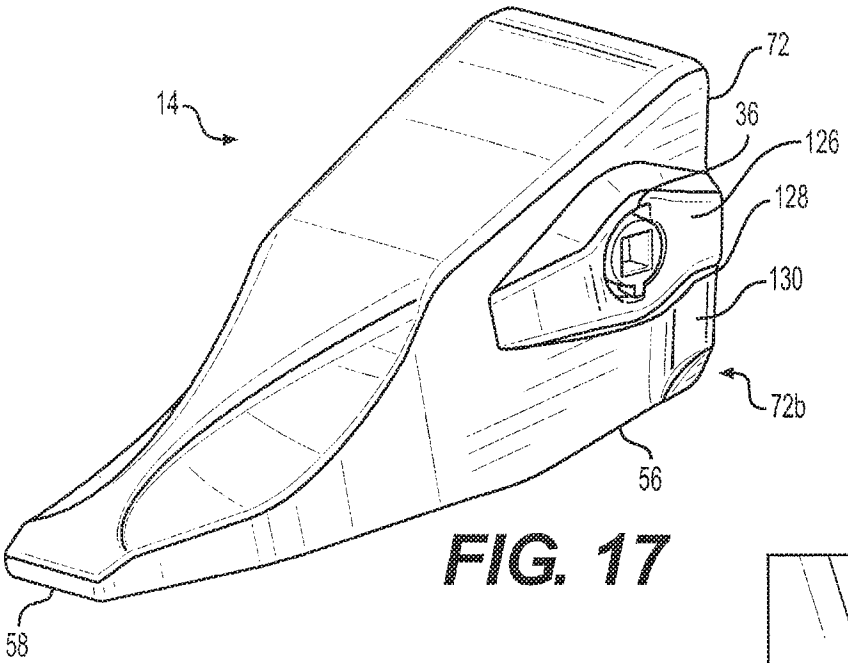

FIG. 17 illustrates a tip 14 consistent with the disclosed embodiments. The tip 14 may have an adapter earpad 126 on the side outer surfaces 57, 59 of the tip 14 at the location of the retention channel 110 within the nose cavity 38. The earpad 126 may protrude from the side outer surfaces 57, 59 because the retention channel 110 accommodates the lug 50, which protrudes from the side surface 46, 48 (FIG. 5) of the adapter nose.

Figure 18:
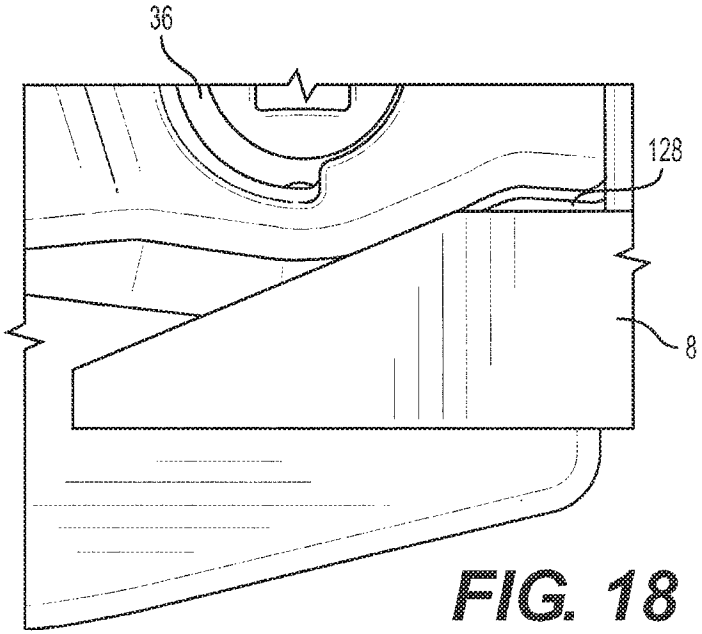

As shown in FIG. 17 and in FIG. 18, the earpad 126 may have a notch 128 at the rear edge 52 of the tip 14. The notch 128 may accommodate the base edge 8 (FIGS. 1, 2) of the bucket 2 when the tip 14 and adapter 12 are installed on the bucket 2.

Returning to FIG. 17, the tip 14 may have a support rib 130 on each side outer surface 57, 59 (one shown). The support rib 130 may be formed from the same material as the surrounding side outer surface 57, 59 of the tip 14. The support rib 130 may an area of the side outer surface 57, 59 that is thicker than the surrounding area of the side outer surfaces 57, 59.

In one embodiment, the support rib 130 may be positioned below the notch 128, at the bottom **52*b* of the rear edge 52** of the tip 14. The support rib 130 may extend lengthwise from the bottom outer surface 56 of the tip 14 to the notch 128.

INDUSTRIAL APPLICABILITY

The disclosed embodiments may be applicable to any tip assembly used on earth-moving equipment. The concave section 72 of the rear portion 60 of the disclosed tip 14 may provide advantages over conventional tips. In particular, the concave section 72 may reduce the amount of material needed to make the tip 14. This may reduce the weight and/or cost of the tip 14. Additionally, since the tip 14 experiences the most impact and wear from material in areas other than the rear portion 60, the concave section 72 may be included in the rear portion 60 without substantially impacting the useful life or integrity of the tip 14.

The disclosed wear indicator 92 may improve the ability of a worker to determine when the tip 14 of an earth-moving machine is worn and should be replaced. Additionally, the wear indicator 92 may indicate that the tip 14 is worn before the adapter 12 is unnecessarily worn or damaged. The wear indicator 92 may help avoid wear or damage to the nose 20 of the adapter, and may also improve the ability to avoid damage or wear of the bottom strap 24 of the adapter 12 in bottom-wearing applications. If the adapter 12 is more expensive or more difficult to obtain than the tip 14, the wear indicator 92 may help reduce the cost and/or improve the efficiency of operating an earth-moving machine.

The disclosed retention channels 110 may aid installation of the tip 14 onto the adapter 12. When installing the tip 14 on the adapter 12, a worker must line up the lugs 50 of the adapter 12 with the retention channels 110 of the tip 14. As the worker pushes the tip 14 onto the nose 20 of the adapter 12, the lugs 50 slide down the retention channel 110 and into the apertures 36. The tapered portion 114 may provide additional area 124 beyond the cross-sectional area of the untapered portion 112 for lining up the lugs 50 with the retention channels 110. This additional area 124 may make it easier for a worker to install the tip 14 on the adapter 12.

Figure 20:
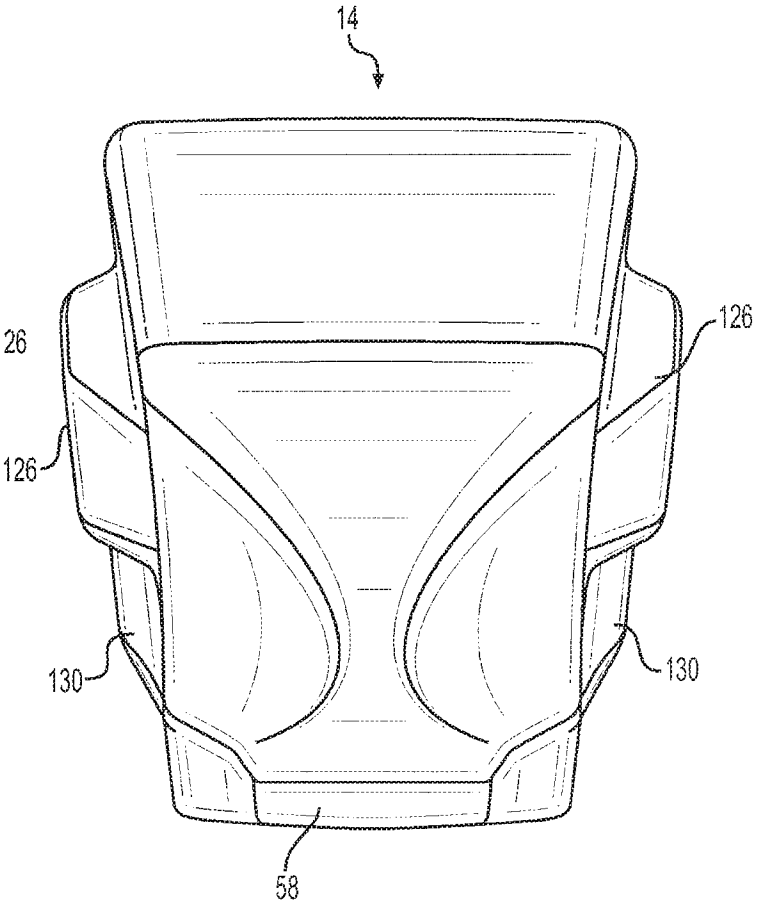
FIGS. 19 and 20 are front views of a tip without the support rib and with the support rib, respectively.
Figure 19:
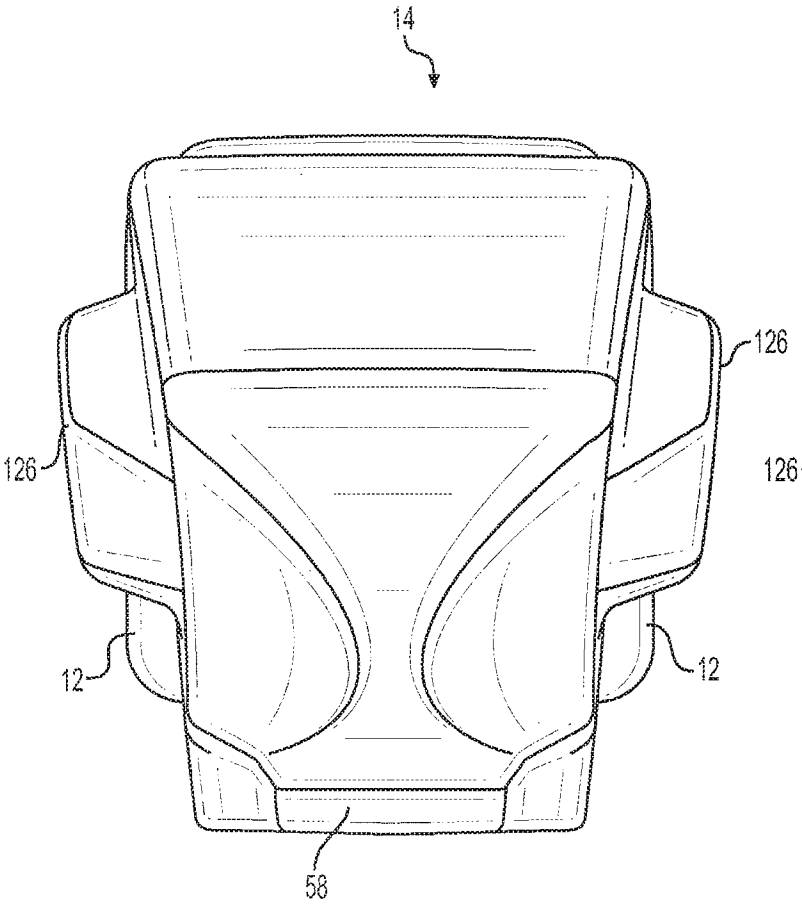

The disclosed support rib 130 may provide support to accommodate stresses in the retention channel 110 during use of the tip 14. The rib 130 may also further protect the adapter 12 from wear or damage. FIGS. 19 and 20 show embodiments of tip assemblies 10 without ribs 130 and with ribs 130, respectively, looking at the front edge 58 of the tip 14 in the direction of the axis "A." As shown in FIG. 19, the corners of the adapter 12 may be outside the profile of the tip 14, and thus exposed to the work material when in use. By contrast, as shown in FIG. 20, the adapter 12 may fall within or mostly within the profile of the tip 14 with the ribs 130, providing additional protection to the adapter 12 during use of the implement 1.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, not impossible. Numerous alternative embodiments could be implemented, using either current technology or technology developed after the filing date of this patent, which would still fall within the scope of the claims defining the invention.

What is claimed is:

1. A ground engaging tip comprising:

a wedge-shaped body with a rear edge and a front edge that is narrower than the rear edge; and a nose cavity defined within the wedge-shaped body of the ground engaging tip and extending from the rear edge toward the front edge, the nose cavity including a wear indicator at a front end of the nose cavity and extending from an inner surface of the nose cavity into the ground engaging tip, wherein the nose cavity further includes bottom, top, side, and front inner surfaces, and the wear indicator includes a bottom surface and is located at an intersection of the bottom and front inner surfaces of the nose cavity and centrally between the side inner surfaces of the nose cavity, wherein a line extending in the direction of a longitudinal axis of the ground engaging tip that intersects the ground engaging tip at the bottom surface of the wear indicator in the inner surface of the nose cavity does not intersect the inner surfaces of the nose cavity.

2. The ground engaging tip of claim 1, wherein the wear indicator comprises an empty region within the inner surface of the ground engaging tip.

3. The ground-engaging tip of claim 1, wherein the wear indicator comprises an area of material different from surrounding material of the tip.

4. The ground-engaging tip of claim 3, wherein the wear indicator comprises an area of material having a different color from surrounding material of the tip.

5. The ground engaging tip of claim 1, wherein a width of the wear indicator is less than a width of the front inner surface.

6. The ground engaging tip of claim 1, wherein the nose cavity is configured to receive a nose of an adapter, and the line extending in the direction of the longitudinal axis of the ground engaging tip assembly that intersects the ground engaging tip at the bottom surface of the wear indicator in the inner surface of the nose cavity also intersects a bottom strap of the adapter.

7. The ground engaging tip of claim 1, wherein a rear portion of a top outer surface of the ground engaging tip has a concave section.

8. The ground engaging tip of claim 6, wherein the side inner surfaces comprise first and second side inner surfaces, and the nose cavity further includes:

an aperture in at least one of the first and second side inner surfaces; and a retention channel defined in at least one of the first and second side inner surfaces, the retention channel extending from the rear edge to the aperture and being configured to guide a lug of the adapter into the aperture during installation of the ground engaging tip on the adapter, wherein the retention channel comprises an untapered portion and a tapered portion.

9. The ground-engaging tip of claim 8, wherein the tapered portion is longer than the untapered portion.

10. A ground engaging tip assembly for a base edge of a ground engaging implement, the ground engaging tip assembly comprising:

an adapter having a nose and top and bottom straps defining a gap for receiving the base edge of the ground engaging implement; and a ground engaging tip, comprising:

a wedge-shaped body with a rear edge and a front edge that is narrower than the rear edge; and a nose cavity, defined within the wedge-shaped body of the ground engaging tip, and extending from the rear edge toward the front edge, for receiving the nose of the adapter therein, the nose cavity including a wear indicator at a front end of the nose cavity and extending from an inner surface of the nose cavity, into the ground engaging tip, wherein the nose cavity further includes bottom, top, side, and front, inner surfaces, and the wear indicator includes a bottom surface and is located at an intersection of the bottom and front inner surfaces of the nose cavity and centrally between the side inner surfaces of the nose cavity, wherein a line extending in the direction of a longitudinal axis of the tip assembly that intersects the ground engaging tip at the bottom surface of the wear indicator in the inner surface of the nose cavity does not intersect the inner surfaces of the nose cavity.

11. The ground engaging tip of claim 10, wherein the wear indicator comprises an empty region within the inner surface of the ground engaging tip.

12. The ground-engaging tip of claim 10, wherein the wear indicator comprises an area of material different from surrounding material of the tip.

13. The ground-engaging tip of claim 12, wherein the wear indicator comprises an area of material having a different color from surrounding material of the tip.

14. The ground engaging tip of claim 10, wherein a width of the wear indicator is less than a width of the front inner surface.

15. The ground engaging tip of claim 10, wherein the line extending in the direction of the longitudinal axis of the tip assembly that intersects the ground engaging tip at the bottom surface of the wear indicator in the inner surface of the nose cavity also intersects a bottom strap of the adapter.

16. The ground engaging tip of claim 10, wherein a rear portion of a top outer surface of the ground engaging tip has a concave section.

17. The ground engaging tip of claim 10, wherein the side surfaces comprise first and second side inner surfaces, and the nose cavity further includes:

an aperture in at least one of the first and second side inner surfaces; and a retention channel defined in at least one of the first and second side inner surfaces, the retention channel extending from the rear edge to the aperture and being configured to guide a lug of the adapter into the aperture during installation of the ground engaging tip on the adapter, wherein the retention channel comprises an untapered portion and a tapered portion.

18. The ground-engaging tip of claim 17, wherein the tapered portion is longer than the untapered portion.

19. A ground engaging tip of a tip assembly for a base edge of a ground engaging implement, wherein the tip assembly includes an adapter configured for attachment to the base edge of the ground engaging implement and having a forwardly extending adapter nose, the ground engaging tip comprising:

a wedge-shaped body with a rear edge and a front edge that is narrower than the rear edge; and a nose cavity, defined within the wedge-shaped body of the ground engaging tip, for receiving the nose of the adapter therein, the nose cavity including a circular-shaped wear indicator at a front end of the nose cavity and extending from an inner surface of the nose cavity, into the ground engaging tip, wherein the nose cavity further includes bottom, top, and front inner surfaces, and the wear indicator includes a bottom surface and is located at an intersection of the bottom and front inner surfaces of the nose cavity, wherein a line extending in the direction of a longitudinal axis of the tip assembly that intersects the ground engaging tip at the bottom surface of the wear indicator in the inner surface of the nose cavity does not intersect the inner surfaces of the nose cavity.

20. The ground engaging tip of claim 19, wherein the wear indicator comprises one of an empty region within the inner surface of the ground engaging tip or an area of material different from surrounding material of the tip.

* * * * *